US005192151A

United States Patent [19]

Mattila

[11] Patent Number: 5,192,151

[45] Date of Patent: Mar. 9, 1993

[54] PRINTER

[75] Inventor: Reijo Mattila, Helsinki, Finland

[73] Assignee: ICL Personal Systems Oy, Helsinki, Finland

[21] Appl. No.: 851,948

[22] Filed: Mar. 16, 1992

[30] Foreign Application Priority Data

Mar. 25, 1991 [FI] Finland ..... 911427

[51] Int. Cl.[5] ..... B41J 11/42

[52] U.S. Cl. ..... 400/579; 400/630; 271/226; 271/245

[58] Field of Search ..... 400/579, 630, 631, 632, 400/632.1, 633, 636, 641, 636.3, 637; 271/226, 228, 234, 235, 236, 245

[56] References Cited

U.S. PATENT DOCUMENTS

| | | | |
|---|---|---|---|
| 3,240,487 | 3/1966 | Templeton | 271/228 |
| 4,743,129 | 5/1988 | Keryhuel et al. | 400/579 |
| 4,878,772 | 11/1989 | Fukumoto et al. | 400/636.3 |

FOREIGN PATENT DOCUMENTS

| | | | |
|---|---|---|---|
| 1144577 | 2/1963 | Fed. Rep. of Germany | 271/245 |
| 45179 | 2/1990 | Japan | 400/636 |
| 75553 | 3/1990 | Japan | 271/228 |

*Primary Examiner*—Edgar S. Burr
*Assistant Examiner*—Ren Yan
*Attorney, Agent, or Firm*—Sughrue, Mion, Zinn, Macpeak & Seas

[57] ABSTRACT

A printer including a print head; a paper path for a document to be printed; and a document transfer device. The document transfer device is arranged in connection with the paper path and provided with parallel drive pulleys (6) gripping the underside of the document and positioned on at least two sequential shafts (5) and with spring-actuated pressure rollers (9) pressing the document from above against the drive pulleys, at least a part of the pressure rollers being provided with drive and the rollers being arranged in parallel, like the drive pulleys, and disposed sequentially above the drive pulleys to form pairs of drive pulleys and pressure rollers. The printer also includes a stop device positioned on the paper path for straightening the document. Two springs (14, 16) pressing a pressure roller downwards against a drive pulley are arranged in connection with a support mechanism of each pressure roller (9) of the first row of pressure rollers, the stiffness of the first spring (14) being substantially stronger than the stiffness of the second spring (16). In addition, a lifting mechanism (17, 18) is provided, by the aid of which the stiffer spring (14) can be released, in which case only the weaker second spring (16) influences the pressure roller and presses it downwards.

2 Claims, 2 Drawing Sheets

PRINTER

Figure 1:
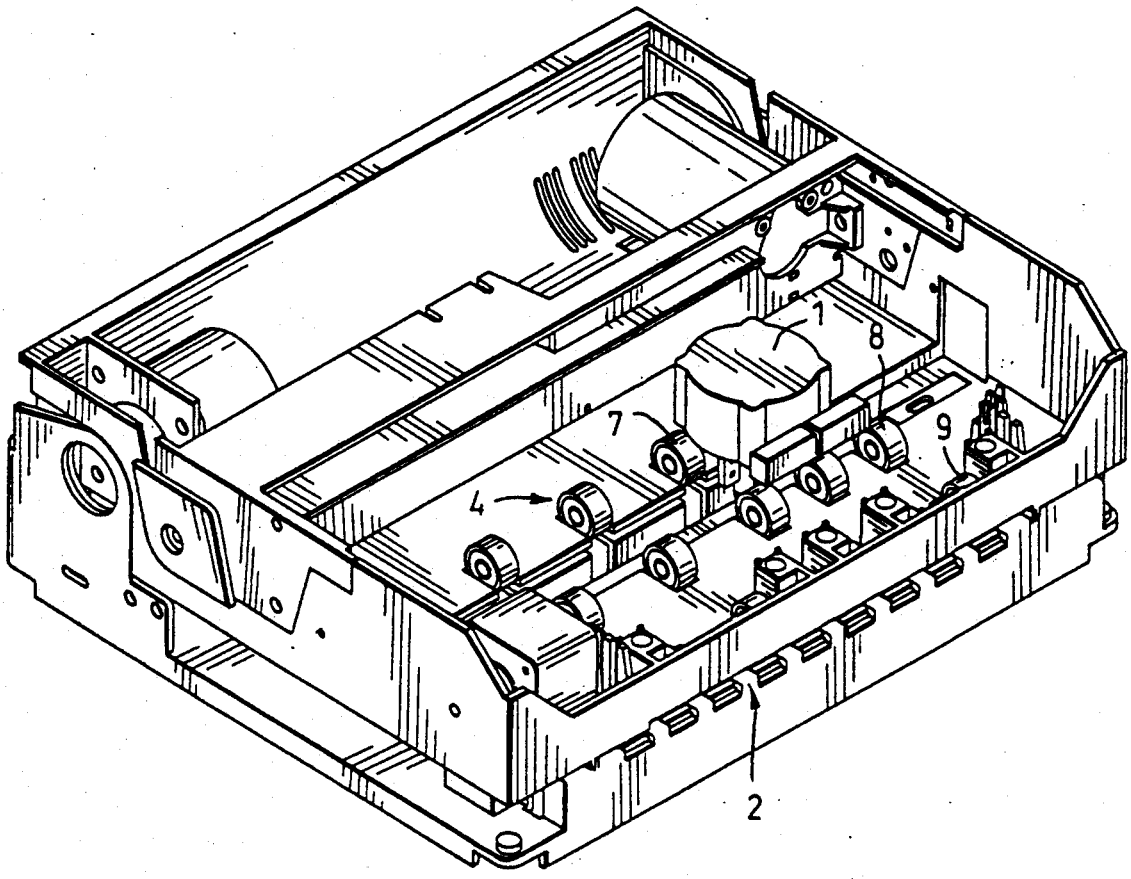

The invention relates to a printer, comprising a print head; a paper path for a document to be printed; and a document transfer device arranged in connection with the paper path and provided with parallel drive pulleys gripping the underside of the document and positioned on at least two sequential shafts and with spring-actuated pressure rollers pressing the document from above against the drive pulleys, at least a part of the pressure rollers being possibly provided with drive and the rollers being arranged in parallel, like the drive pulleys, and sequentially above the drive pulleys to form pairs of drive pulleys and pressure rollers; and stop means positioned on the paper path for straightening the document.

A document to be printed in printers of this type is straightened before it is fed in for printing. In prior art document straightening mechanisms, the document is straightened by placing it manually against the stop means.

The object of the present invention is to eliminate the problems occurring earlier at document straightening and to provide a novel solution, which makes an automation of document straightening possible. This object is achieved by means of the solution of the invention, which is mainly characterized in that two springs pressing a pressure roller downwards against a drive pulley are arranged in connection with support means of each pressure roller of at least the first row of pressure rollers; that the stiffness of the first spring is substantially stronger than the stiffness of the second spring; and that means are arranged, by the aid of which the first spring with stronger stiffness can be released, in which case only the weaker second spring influences the pressure roller and presses it downwards.

In a printer according to the invention, printing begins by placing a document as far into a feed opening that it reaches the first pairs of pulleys and rollers. After this the grip is loosened, due to which the pulleys and rollers grip the document and begin to move it into the printer. The number of pulleys and rollers can be for instance 36, half of which or all except the first pressure rollers are driving and positioned for instance on three fixed shafts on the underside of the paper path and the remaining 18 individually spring-actuated on each pulley of the underside. The first fixed shaft with its drive pulleys and the individually spring-actuated pressure rollers belonging thereto form a system of pulleys and rollers substantially connected with the document straightening mechanism. By means of this system the document is fed during straightening operation as far into the printer that the front edge of the document hits the stop means closing the paper path for the time of the straightening operation. After the document has hit the stop means, the driving pulleys begin to slide and the document is straightened to be parallel with the stop means. During sliding the pressure rollers are pressed against the pulleys of the underside by a very slight load, and after the document has been straightened, the load of the pressure rollers is changed to manifold, whereby the driving pulleys are not able to slide any more. After this the stop means is moved away and the straightened document is fed into the printer for printing.

It is most preferable to use tension springs and together with them a support means structure, comprising a support arm, on which a pressure roller is mounted in bearings one-sidedly; a support base; a first sleeve fastened to the support base, in which sleeve the support arm is slidingly arranged from below; a second sleeve slidingly arranged within the first sleeve in the upper end thereof and being in continuous contact with the upper end of the support arm; a spring fastener resting on the upper end of the second sleeve; and a cover plate positioned below the parts mentioned above and resting on the underside of the support base; the first stiffer drawspring being positioned within the support arm and the second sleeve and at its first end fastened to the spring fastener and at its second end to the cover plate, while the weaker second spring is fastened between the second sleeve and the cover plate.

Figure 2:
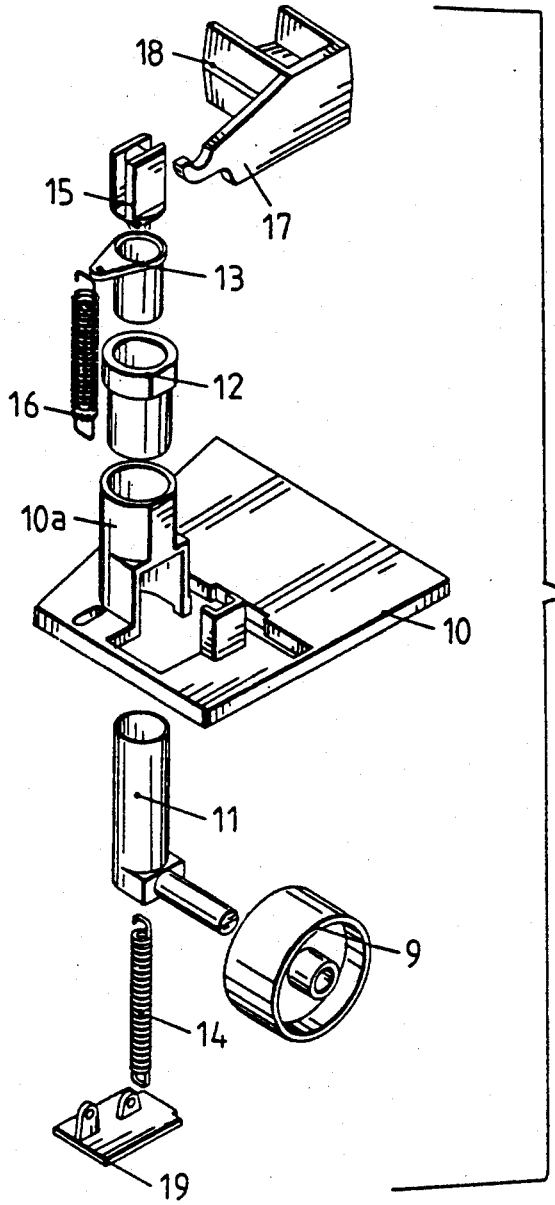

The invention will be described below in greater detail by means of a preferred embodiment referring to the accompanying drawings, in which FIG. 1 shows a simplified general view of a printer, FIG. 2 an exploded view of parts relating to the support of the pressure rollers of the first row of pressure rollers, and FIG. 3 a row of pressure rollers formed by pressure rollers consisting of the parts according to FIG. 2.

A printer according to FIG. 1 comprises a print head 1, a paper path 2 for a document 3 (FIG. 3) to be printed and a document straightening and transfer device 4 arranged in connection with the paper path 2. In FIG. 1 the printer is shown simplified and all parts and details thereof have not been described.

Figure 3:
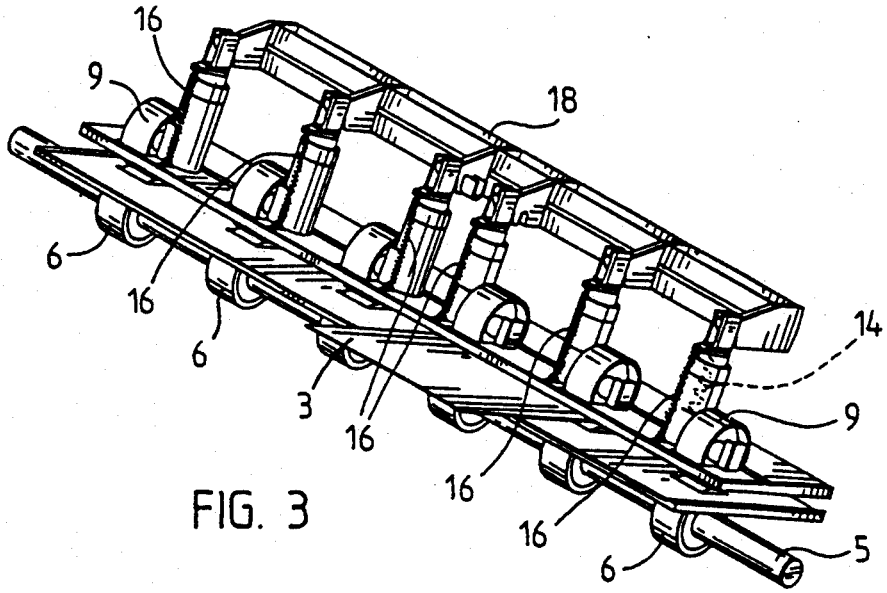

The straightening and transfer device 4 comprises parallel drive pulleys 6 gripping the underside of the document 3 and positioned on three sequential shafts 5 as well as spring-actuated pressure rollers 7, 8 and 9 pressing the document 3 against the drive pulleys 6 from above and possibly also provided with drive, except for the pressure rollers 9, and arranged in parallel, like the drive pulleys 6, and sequentially above the drive pulleys 6 to form pairs of drive pulleys and pressure rollers (FIG. 3). In FIG. 1 the drive pulleys 6 with the shafts 5 are hidden below the pressure rollers 7, 8 and 9. The device 4 further comprises stop means (not shown in the drawings) positioned on the paper path 2 for straightening the document 3.

The first row of pressure rollers is substantially connected with the document 3 straightening mechanism and each pressure roller 9 of this row of pressure rollers is supported on its support base 10 by means of support means, comprising a support arm 11, on which the pressure roller 9 is mounted in bearings one-sidedly; a first sleeve 12 arranged in a sleeve part 10*a* of the support base 10 from above, within which sleeve the support arm 11 is slidingly arranged from below; a second sleeve 13 slidingly arranged within the first sleeve 12 in the upper end thereof and being in continuous contact with the upper end of the support arm 11; a first spring 14 arranged within the support arm 11 and the second sleeve 13 and at its first end fastened to a spring fastener 15 resting on the end of the second sleeve 13 and at its second end to a cover plate 19 resting on the underside of the support base 10; and a second spring 16 fastened between the second sleeve 13 and the cover plate 19, outside the parts 10*a*, 12 and 13.

The springs 14 and 16 are tension springs and they press the pressure rollers 9 downwards against the drive pulleys 6. The stiffness of the first springs 14 is about 10 times stronger than the stiffnes of the second springs 16. In addition, lifting means 17 arranged at a common lifting frame 18 are provided at the spring fastener 15, by means of which lifting means the first springs 14 can be released, i.e. disengaged from the second sleeves 13. After the release of the first springs 14, only the weaker second springs 16 influence the pressure rollers 9 and press them downwards. The second springs 16 cannot be released, and therefore, the pressure rollers 9 are continuously pressed against the drive pulleys 6 at least by these springs.

The individually spring-actuated pressure roller arrangement with the structure described above is used for document straightening in such a way that the pressure rollers 9 are loaded only by means of the weaker second springs 16 for straightening the document 3, and then, the document 3 being supported against the stop means, the drive pulleys 6 are able to slide so that the document can be straightened against the stop means. After the document 3 has been straightened, the stop means are drawn away from the paper path 2 and the first stiffer springs 14 are engaged, and then the document 3 can move forward on the paper path 2 for printing. The support of the pressure rollers according to the invention is sensitive, and consequently, the document will be reliably straightened, even if its thickness were not the same all over.

I claim:

1. A printer for printing on a document, comprising:

a print head;

a paper path for the document to be printed; and a document transfer device arranged in connection with said paper path, said document transfer device comprising: a plurality of drive pulleys arranged in parallel for gripping an underside of the document and positioned in at least two sequential rows, and a plurality of spring-actuated pressure rollers arranged in parallel and disposed across the entire paper path in two rows sequentially above said drive pulleys so as to form pairs of drive pulleys and pressure rollers, with said pressure rollers pressing the document from above against said drive pulleys;

said document transfer device further comprising: support means for each of said pressure rollers situated in one of said two rows of pressure rollers; a first spring and a second spring, for pressing each of said pressure rollers downwards against a corresponding drive pulley, are arranged in connection with said support means of each of said pressure rollers, whereby a stiffness of said first spring is substantially stronger than a stiffness of said second spring; and release means for releasing said first spring having the stronger stiffness, in which case only said second spring having a weaker stiffness influences the corresponding pressure roller and presses it downwards, and wherein said support means comprises a support arm, on which a corresponding one of said pressure rollers is mounted in bearings; a support base; a sleeve connected to said support base, within which sleeve said support arm is slidingly arranged from below; said first stiffer spring being arranged to press said support arm, and said second weaker spring being arranged between said support arm and said support base so that said first and second springs press said support arm and said corresponding one of said pressure rollers connected thereto against a corresponding one of said drive pulleys.

2. The printer according to claim 1, wherein said release means comprises a lifting bar extending on one side of the one row of pressure rollers and wherein one end of each of said first springs is fastened to a corresponding said lifting bar, each of said first springs being releasable by lifting the corresponding said lifting bar.

* * * * *